US008348702B2

(12) United States Patent
Lin

(10) Patent No.: US 8,348,702 B2
(45) Date of Patent: Jan. 8, 2013

(54) WIRE STABILIZER HAVING SEVEN CHANNELS FOR EIGHT CORE WIRES OF A NETWORK CABLE

(75) Inventor: Yen-Lin Lin, New Taipei (TW)

(73) Assignee: Jyh Eng Technology Co., Ltd., New Taipei (TW)

( * ) Notice: Subject to any disclaimer, the term of this patent is extended or adjusted under 35 U.S.C. 154(b) by 0 days.

(21) Appl. No.: 13/157,064

(22) Filed: Jun. 9, 2011

(65) Prior Publication Data

US 2012/0315786 A1 Dec. 13, 2012

(30) Foreign Application Priority Data

Apr. 19, 2011 (TW) ..... 100206822 U

(51) Int. Cl.
*H01R 24/00* (2006.01)

(52) U.S. Cl. ..... 439/676

(58) Field of Classification Search ..... 439/418, 439/941, 676, 894
See application file for complete search history.

(56) References Cited

U.S. PATENT DOCUMENTS

| | | | | |
|---|---|---|---|---|
| 5,571,035 | A * | 11/1996 | Ferrill | 439/894 |
| 6,358,092 | B1 * | 3/2002 | Siemon et al. | 439/607.02 |
| 6,962,503 | B2 * | 11/2005 | Aekins | 439/418 |
| 7,175,468 | B1 * | 2/2007 | Chang | 439/418 |
| 7,220,149 | B2 * | 5/2007 | Pharney | 439/676 |

* cited by examiner

*Primary Examiner* — Chandrika Prasad
(74) *Attorney, Agent, or Firm* — Guice Patents PLLC

(57) ABSTRACT

A wire stabilizer for 8-core twisted-pair network plug having a first wire channel and a second wire channel respectively arranged at left side and right sides thereof, and two third wire channels, a fourth wire channel and two fifth wire channels arranged at different elevations between the first wire channel and the second wire channel. The first wire channel and the second wire channel are adapted for accommodating the twisted pair of the first and second core wires and the twisted pair of the seventh and eighth core wires respectively. The fourth wire channel is adapted for accommodating the twisted pair of the fourth and fifth core wires. The two third wire channels and the two fifth wire channels are adapted for accommodating the pair of the third and sixth core wires selectively. The third and sixth core wires are kept apart, the invention enhances network characteristics.

5 Claims, 4 Drawing Sheets

WIRE STABILIZER HAVING SEVEN CHANNELS FOR EIGHT CORE WIRES OF A NETWORK CABLE

BACKGROUND OF THE INVENTION

1. Field of the Invention

The present invention relates to network connectors and more particularly, to a wire stabilizer for network plug, which facilitates network plug installation and enhances network characteristics.

2. Description of the Related Art

Following fast development of network technology, people can connect a personal computer or notebook computer to the Internet to fetch data from a remote source. A personal computer or notebook computer generally has a connection port for the connection of a network plug of a network cable for data transmission. Connect network cable is an 8-core cable for signal transmission. However, network connection quality is not absolutely stable. The internal structure in a network cable between a network plug and a network jack may affect the high-frequency network transmission quality.

A network cable is normally an 8-core twisted-pair cable that is inserted through a jacket to have the 8 core wires be arranged in a respective wire channel in a wire stabilizer and then respectively and electrically connected to one respective piercing terminal in a modular plug. The 8 core wires are arranged in four twisted pairs. The first and second core wires are twisted into a twisted pair. The third and sixth core wires are twisted into a twisted pair. The fourth and fifth core wires are twisted into a twisted pair. The seventh and eighth core wires are twisted into a twisted pair.

During data (signal) transmission through a network cable, a magnetic effect (magnetic field) will be produced around the core wires. The two core wires of each twisted pair can create complementary effects. However, the magnetic field produced between any two adjacent core wires of different twisted pairs can cause interference, affecting signal transmission. More particularly, the twisted pair of the fourth and fifth core wires may be interfered by the magnetic field produced between the third and fourth core wires and the magnetic field produced between the fifth and sixth core wires, causing crosstalk and affecting signal transmission quality.

To eliminate the aforesaid problem, a specially designed wire stabilizer may be used to keep the third core wire, the fourth core wire, the fifth core wire and the sixth core wire apart for separate connection to the respective piercing terminals in the modular plug, maintaining network characteristics. U.S. Pat. No. 6,962,503, entitled "Unshielded twisted pair wire stabilizer for communication plug, discloses a stabilizer device for controlling de-embedded NEXT and FEXT variations that produced during patch cordage assembly by receiving a data transfer media cable having data elements therein, protecting against distortion of the elements which usually occurs during installation with a media plug and guiding the elements into the proper alignment to be easily connected with a media plug. The stabilizer provides a plurality of guides, the plurality of guides including a first guide, a second guide, a third guide, and a fourth guide for each receiving a respective pair of the plurality of pairs of data transmitting elements. The first guide and the second guide are disposed in a column. The third guide and the fourth guide are disposed in a row. The column is disposed between the third guide and the fourth guide and perpendicular to the row.

When connecting network plugs to the two ends of a network cable, a mirror problem occurs at the ends of the network cable. During installation, the twisted pair of the third and sixth core wires and the twisted pair of the fourth and fifth core wires may be erroneously changed. These two twisted pairs may have to be alternatively arranged to fit matching. The aforesaid prior art wire stabilizer design cannot avoid misinstallation. An improvement in this regard is necessary.

Further, in some conventional wire stabilizer designs, the core wires of the twisted pairs must be spread out and separately arranged in respective wire channels in the stabilizer, obstructing the complementary function of twisted pairs.

SUMMARY OF THE INVENTION

The present invention has been accomplished under the circumstances in view. It is main object of the present invention to provide a wire stabilizer for 8-core twisted-pair network plug, which facilitates quick installation and enhances the network characteristics.

To achieve this and other objects of the present invention, a wire stabilizer for 8-core twisted-pair network plug comprises a first wire channel and a second wire channel respectively arranged at left side and right sides thereof, and two third wire channels, a fourth wire channel and two fifth wire channels, arranged at different elevations between the first wire channel and the second wire channel. The first wire channel and the second wire channel are adapted for accommodating the twisted pair of the first and second core wires and the twisted pair of the seventh and eighth core wires respectively. The fourth wire channel is adapted for accommodating the twisted pair of the fourth and fifth core wires. The two third wire channels and the two fifth wire channels are adapted for accommodating the pair of the third and sixth core wires selectively.

Thus, when connecting the network plug to the network cable, the worker needs not to memorize the installation position of the twisted pair of the third and sixth core wires, facilitating quick installation. Further, as the third and sixth core wires are kept apart, the invention enhances network characteristics.

The wire stabilizer further comprises two parallel locating bars arranged at two opposite lateral sides thereof and fastened to the jacket at the rear side of the network plug, an open chamber defined between the two parallel locating bars and adapted for keeping the twisted pairs of the core wires of the network cable in shape, and two elastic retaining members arranged at the rear side thereof in a front middle position relative to the open chamber and adapted to hold the twisted pair of the third and sixth core wires and the twisted pair of the fourth and fifth core wires in the twisted status before insertion of the respective core wires into the third and fifth wire channels and the fourth wire channel.

DETAILED DESCRIPTION OF THE PREFERRED EMBODIMENT

Figure 1:
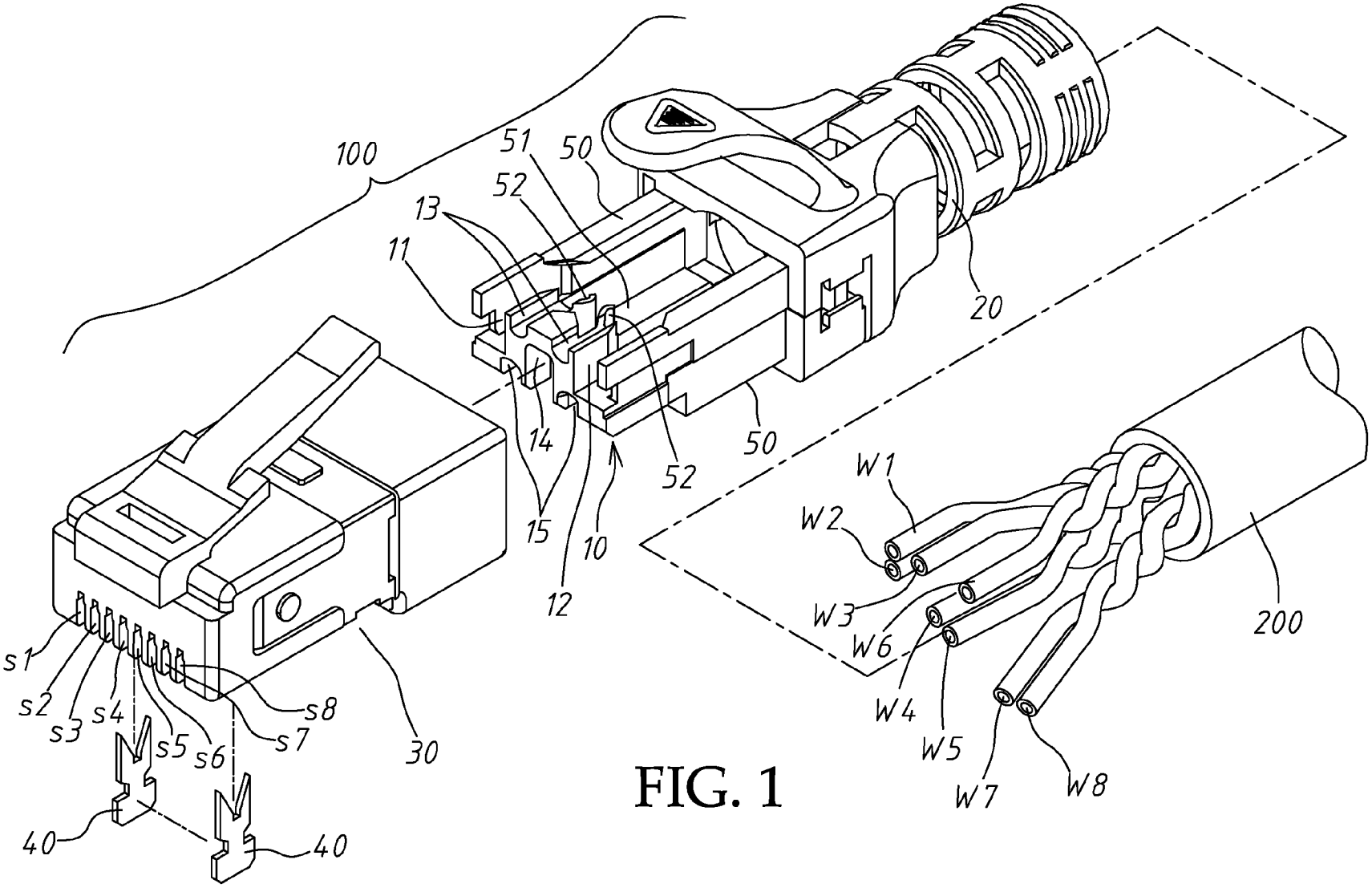
FIG. 1 is an exploded view of a network plug and an 8-core twisted-pair network cable in accordance with the present invention.

Referring to FIG. 1, a wire stabilizer 10 is shown installed in a network plug 100, which is connected with a network cable 200 having 8 core wires w1~w8, wherein the first and second core wires w1;w2 are twisted into a twisted pair; the third and sixth core wires w3;w6 are twisted into a twisted pair; the fourth and fifth core wires w4;w5 are twisted into a twisted pair; the seventh and eighth core wires w7;w8 are twisted into a twisted pair. After insertion of the twisted pairs of the core wires w1~w8 of the network cable 200 through a jacket 20, the 8 core wires w1~w8 are spread out and inserted through the wire stabilizer 10, a modular plug 30 is attached to the wire stabilizer 10 and the jacket 20. At this time, piercing terminals 40 that are respectively mounted in the 8 terminal grooves s1~s8 in the modular plug 30 are respectively forced into electric contact with the respective core wires w1~w8. Thus, the network plug 100 is assembled.

Figure 2:
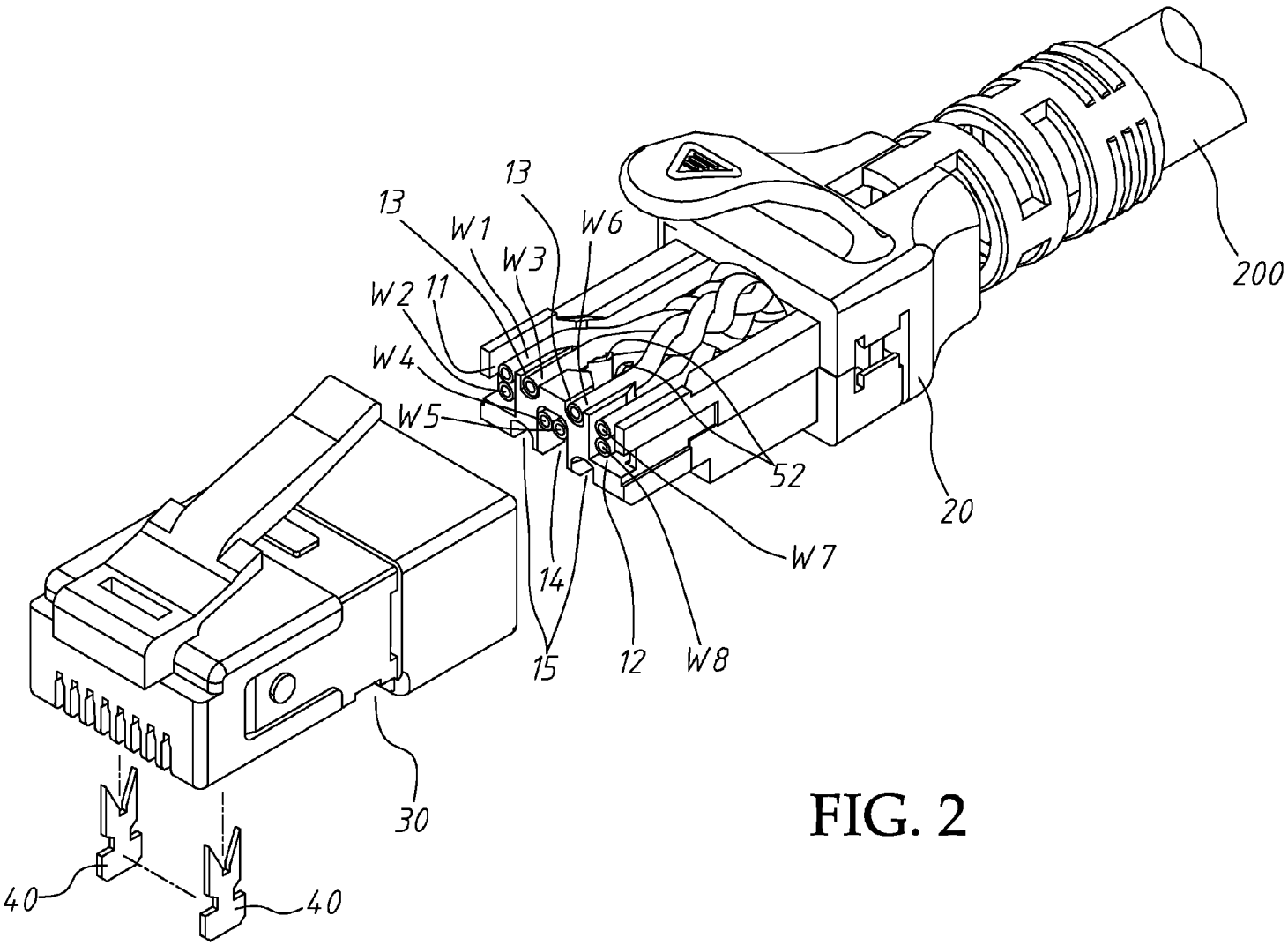
FIG. 2 corresponds to FIG. 1, illustrating the 8-core twisted-pair network cable fastened to the jacket and the wire stabilizer.
Figure 5:
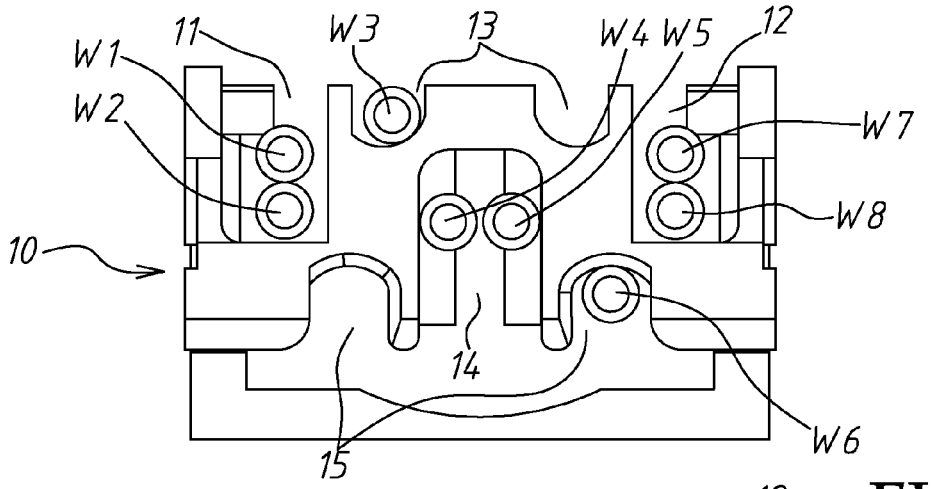
FIG. 5 is a plain view illustrating still another example of the arrangement of the third and sixth core wires in the wire stabilizer in accordance with the present invention.
Figure 4:
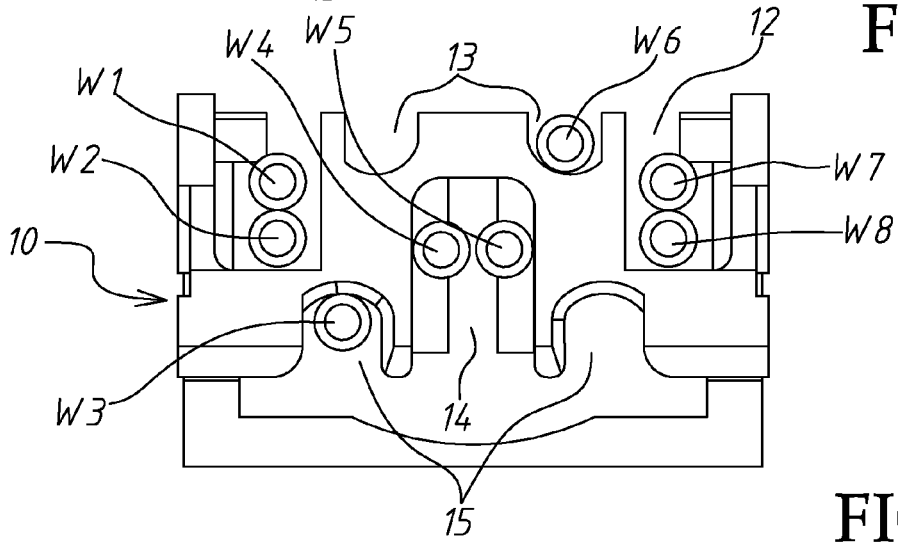
FIG. 4 is a plain view illustrating another example of the arrangement of the third and sixth core wires in the wire stabilizer in accordance with the present invention.
Figure 3:
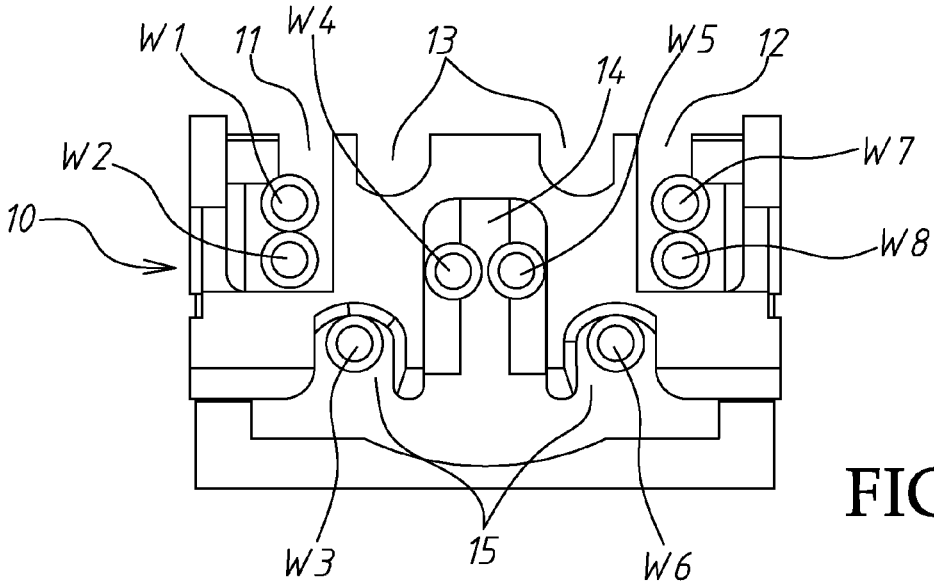
FIG. 3 is a plain view illustrating one example of the arrangement of the third and sixth core wires in the wire stabilizer in accordance with the present invention.

The wire stabilizer 10 comprises seven wire channels 11~15, wherein the first wire channel 11 and the second wire channel 12 are respectively arranged at the left side and the right side, and the other five wire channels, namely, two third, a fourth and two fifth wire channels 13~15 are arranged on the middle at different elevations between the first wire channel 11 and the second wire channel 12. There are two third wire channels 13 and two fifth wire channels 15. Further, as shown in FIG. 2, the first wire channel 11 and the second wire channel 12 are respectively adapted for accommodating the twisted pair of the first and second core wires w1;w2 and the twisted pair of the seventh and eighth core wires w7;w8; the fourth wire channel 14 is adapted for accommodating the twisted pair of the fourth and fifth core wires w4;w5; and the third and sixth core sires w3;w6 are shown in the two third wire channels 13. The two third wire channels and the two fifth wire channels 13;15 are adapted for accommodating the pair of the third and sixth core wires w3;w6 selectively. The third and sixth core wires w3;w6 can be accommodated in the two fifth wire channels 15 (see FIG. 3), or separately accommodated in the two third wire channels 13 and the two fifth wire channels 15 (see FIG. 4 and FIG. 5).

As stated above, the wire stabilizer 10 comprises 5 wire channels 11~15; the third and sixth core wires w3;w6 can be selectively accommodated in the third wire channel 13 and the fifth wire channel 15. When connecting the network plug 100 to the network cable 200, the worker needs not to memorize the installation position of the twisted pair of the third and sixth core wires w3;w6, facilitating quick installation. Further, as the third and sixth core wires w3;w6 are kept apart, the invention enhances network characteristics.

Figure 6:
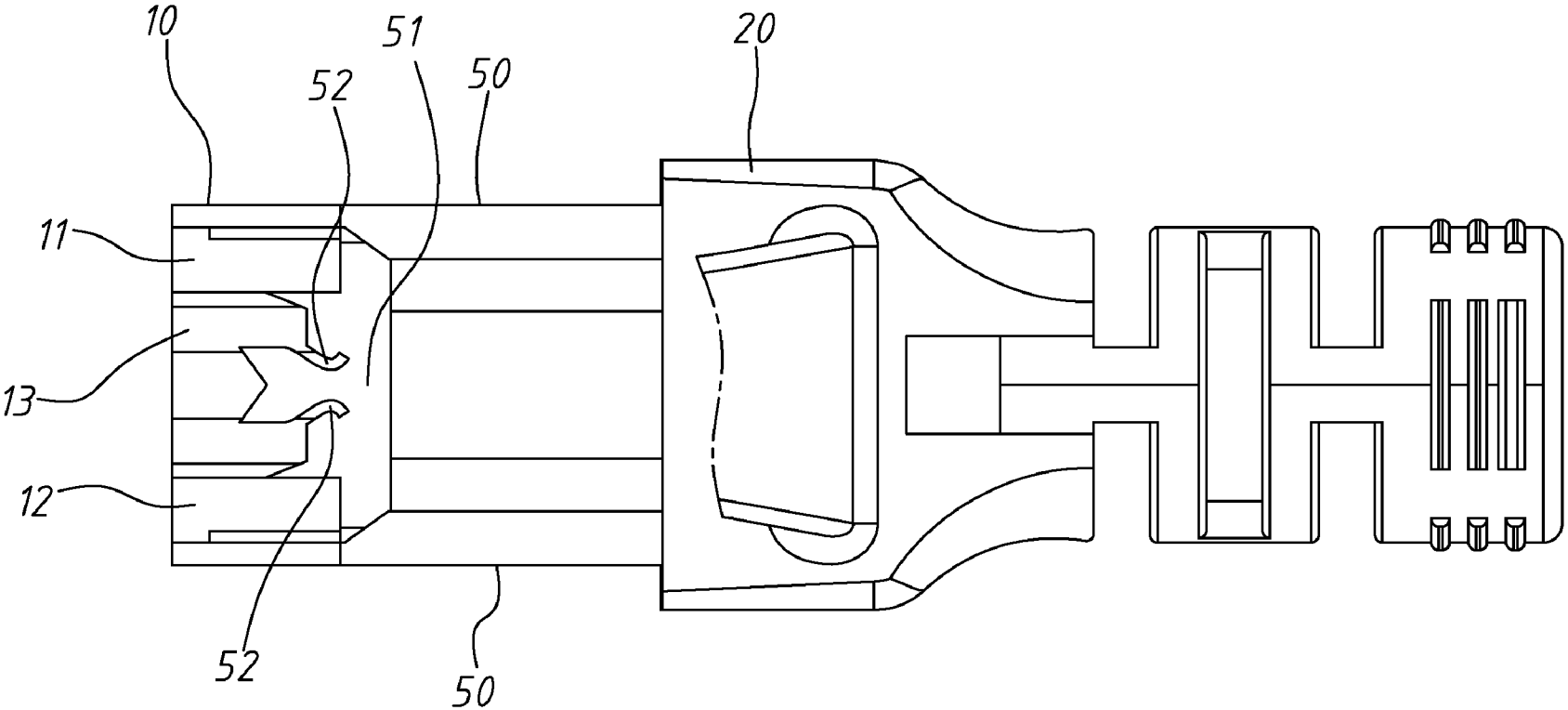
FIG. 6 is a plain view of the present invention, illustrating the connection arrangement between the wire stabilizer and the jacket.

Further, the wire stabilizer 10 comprises two parallel locating bars 50 arranged at two opposite lateral sides thereof and fastened to the front side of the jacket 20, as shown in FIG. 6, an open chamber 51 defined between the two parallel locating bars 50 and adapted for keeping the twisted pairs of the core wires w1~w8 in shape, and two elastic retaining members 52 arranged at a rear side thereof on the middle in front of the open chamber 51 and adapted to hold the twisted pair of the third and sixth core wires w3;w6 and the twisted pair of the fourth and fifth core wires w4;w5 in the twisted status (see FIG. 2). After extending through the tapered gap between the two elastic retaining members 52, the third and sixth core wires w3;w6 and the fourth and fifth core wires w4;w5 are spread out and respectively accommodated in the third and fifth wire channels 13;15 and the fourth wire channel 14.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A wire stabilizer installed in a network plug being connected with a network cable having eight core wires including a first core wire, a second core wire, a third core wire, a fourth core wire, a fifth core wire, a sixth core wire, a seventh core wire, and an eighth core wire, the first and second core wires are twisted into a first twisted pair; the third and sixth core wires are twisted into a second twisted pair; the fourth and fifth core wires are twisted into a third twisted pair; the seventh and eighth core wires are twisted into a fourth twisted pair, the first, second, third, and fourth twisted pairs of the eight core wires of said network cable being inserted through a jacket and then the eight core wires are spread out and inserted through said wire stabilizer and electrically connected to a respective piercing terminal in a modular plug, wherein:

said wire stabilizer comprises seven wire channels, said seven wire channels include a first wire channel and a second wire channel respectively arranged at left side and right sides thereof, and two third wire channels, a fourth wire channel and two fifth wire channels located at different elevations between said first wire channel and said second wire channel with respect to a top surface and a bottom surface of the wire stabilizer, said first wire channel and said second wire channel being adapted for accommodating said first and second core wires and said seventh and eighth core wires respectively, said fourth wire channel being adapted for accommodating said fourth and fifth core wires, said two third wire channels and said two fifth wire channels being adapted for accommodating said third and sixth core wires selectively, each of said first wire channel, said second wire channel and said fourth wire channel is capable of accommodating two core wires and each of said two third wire channel and said two fifth wire channels is capable of accommodating one core wire;

wherein each channel of said first wire channel, said second wire channel and said fourth wire channel positioning two corresponding core wires adjacent to one another and each channel of said two third wire channels and said two fifth wire channels positioning two corresponding core wires in a spaced apart configuration;

wherein said first wire channel, said second wire channel and said two third wire channels communicating with the top surface of the wire stabilizer and said fourth wire channel and said two fifth wire channels communicating with the bottom surface of the wire stabilizer.

2. The wire stabilizer as claimed in claim 1, further comprising two parallel locating bars arranged at two opposite lateral sides thereof and fastened to said jacket, and an open chamber defined between said two parallel locating bars and adapted for keeping the twisted pairs of the core wires of said network cable in shape.

3. The wire stabilizer as claimed in claim 2, further comprising two elastic retaining members arranged at a rear side thereof in a front middle position relative to said open chamber and adapted to hold the second twisted pair of said third and sixth core wires and the third twisted pair of said fourth and fifth core wires in the twisted status before insertion of the respective core wires into said third and fifth wire channels and said fourth wire channel.

4. The wire stabilizer as claimed in claim 1, wherein said third and sixth core wires are positioned in two wire positions selected from a group consisting of both of the third and sixth core wires are located in the two third wire channels and said two fifth wire channels are empty, both of the third and sixth core wires are located in the two fifth wire channels and said two third wire channels are empty, the third core wire is located in one of the two third wire channels and the sixth core wire is located in one of the two fifth wire channels;

and the third core wire is located in one of the two fifth wire channels and the sixth core wire is located in one of the two third wire channels.

5. The wire stabilizer as claimed in claim 1, wherein two wire positions of the four wire positions of the two third wire channels and the two fifth wire channels are empty.

* * * * *